United States Patent [19]

Kaiser

[11] Patent Number: 5,044,612

[45] Date of Patent: Sep. 3, 1991

[54] APPARATUS TO CLEAN REFRACTORY-LINED CONVEYOR TROUGHS

[75] Inventor: Heinrich Kaiser, Salzgitter, Fed. Rep. of Germany

[73] Assignee: Stahlwerke Peine-Salzgitter AG, Peine, Fed. Rep. of Germany

[21] Appl. No.: 546,546

[22] Filed: Jun. 29, 1990

Related U.S. Application Data

[63] Continuation-in-part of Ser. No. 505,050, Apr. 4, 1990.

[30] Foreign Application Priority Data

Aug. 12, 1988 [DE] Fed. Rep. of Germany ..... 3827401

[51] Int. Cl.[5] ..... C21B 9/10

[52] U.S. Cl. ..... 266/135; 266/142; 266/281

[58] Field of Search ..... 266/135, 281, 287, 142

[56] References Cited

U.S. PATENT DOCUMENTS 2,825,372 3/1958 Talboys ..... 144/92

3,144,835 8/1964 Pehoski et al. ..... 104/17

4,871,211 10/1989 Aussel ..... 266/281

FOREIGN PATENT DOCUMENTS 668333 12/1938 Fed. Rep. of Germany .

3225015 11/1983 Fed. Rep. of Germany .

*Primary Examiner*—S. Kastlea

*Attorney, Agent, or Firm*—Thomas N. Ljungman

[57] ABSTRACT

An apparatus for cleaning refractory-lined conveyor troughs for conveying molten metals and slags has a rail-guided carriage that extends across the trough and travels along the length of the trough, with a cleaning head supported by the carriage. Two wheels on the carriage travel along a guide rail on one side of the trough while a non-powered idler roller on the carraige travels along the other side. Lateral, opposed, rotatable guide rollers are provided on each side of the guide rail adjacent each wheel. Metal plates are situated in the floor beneath the guide rail, while small plates and/or shims are provided to compensate for irregularities between the guide rail and the metal plates.

20 Claims, 2 Drawing Sheets

APPARATUS TO CLEAN REFRACTORY-LINED CONVEYOR TROUGHS

CROSS-REFERENCE TO RELATED APPLICATION

This application is a continuation-in-part of co-pending application Ser. No. 07/505,050, filed Apr. 4, 1990 in the name of Heinrich Kaiser, the inventor herein, assigned to the assignee of the present invention, and entitled "Process and Apparatus to Clean a Molten Metal or Slag Conveyor Trough", which application is incorporated by reference herein.

This application is also a continuation-in-part of International patent application PCT/DE89/00503 filed Aug. 1, 1989.

BACKGROUND OF THE INVENTION

1. Field of the Invention

This invention relates to an apparatus for cleaning refractory lined conveyor troughs for molten metals and slags, and in particular, to the equipment used to move the apparatus along the conveyor trough during the cleaning of the trough wall.

2. BACKGROUND INFORMATION

German Patent No. 32 25 015 discloses an apparatus for the cleaning of refractory-lined conveyor troughs using conveyor chains circulating on a rotating drum. This apparatus can be moved along the trough by means of wheels which are guided in tracks on both sides of the trough. However, the arrangement disclosed therein, with two guide tracks in the form of broad grooves for the four wheels, is considered an undesirable solution for the following reasons. Under the thermal effect of molten metal and hot slags, the floor of the building, and in particular, the foundation in the vicinity of the trough, can be deformed, which leads to permanent deformation of the tracks permanently installed on or in the foundation, so that it is impossible to achieve a perfect guidance parallel to the trough and uniform contact of all the wheels. Irregularities in the guideway not only complicate the operation of the apparatus, but also have a disadvantageous effect on the cleaning process. Such tracks also present an increased risk of accidents during the operation of the trough. Such tracks may also become unusable if the trough overflows.

It is known, of course, that a three-point contact guarantees the stable position of an object even on an uneven floor. In the present case, however, the carriage of the apparatus, whose overall length is relatively short in relation to its width, must be guided in as parallel a fashion as possible to the center of the trough on a floor which is continuously changing under the influence of thermal factors. These changes result not only in height differences of the contact on the tracks, but also to changes in the track width, if two tracks are used. It should also be noted that the cleaning process can also exert lateral forces on the carriage. The present invention solves this problem in a simple manner, which manner is also suitable for an operating environment of a blast furnace. The guidance of the carriage according to the invention is particularly advantageous for use on non-track guided equipment, e.g. excavator vehicles, on which a cleaning head is mounted.

OBJECT OF THE INVENTION

An object of the invention is, therefore, to improve the equipment used to move a trough cleaning apparatus, with regard to the changes which occur to the floor of the building, and to avoid the danger of accidents.

SUMMARY OF THE INVENTION

An apparatus for cleaning refractory-lined conveyor troughs for molten metals and slags has a rail-guided carriage that extends across and is movable in a longitudinal direction along the trough, with a cleaning apparatus mounted on the carriage. A single removeable guide rail is provided on one side of the trough. The carriage has two wheels that are engageable with the guide rail and at least one of the wheels is motor driven. A pair of lateral, opposed, guide rollers, which rotate around a vertical axis are provided, one on each side of the guide rail adjacent the wheel. A non-powered idler roller is provided on the carriage on the other side of the trough. A plurality of metal plates are provided in the floor beneath the guide rail and preferably at least one of these metal plates has a slot therein in which a guide bolt on the underside of the guide rail is inserted. Irregularities between the metal plates, on which the guide rail sits and the guide rail, are compensated for by small plates on the underside of the guide rail and/or stackable shims, with a threaded bolt used as an adjusting screw in the small plates.

In summary, one aspect of the invention resides broadly in an apparatus to clean refractory-lined conveyor troughs for molten metals and slags comprising: a single removeable guide rail disposed along one side of the trough; a rail-guided carriage which is movable in the longitudinal direction over the conveyor trough, and extends across said trough: a cleaning apparatus mounted on said rail-guided carriage: two wheels on said carriage, at least one of which is motor driven, engageable with said guide rail; a pair of lateral guide rollers which can rotate around a vertical axis, each roller of a pair on opposite sides of the guide rail adjacent a said wheel: and a non-powered idler roller on said carriage on the other side of said trough.

BRIEF DESCRIPTION OF THE DRAWINGS

Additional details of the trough cleaning machine, in particular, of the guidance of the carriage according to the invention, are described below with reference to the attached simplified schematic drawings, wherein.

DESCRIPTION OF THE PREFERRED EMBODIMENTS

Figure 1:
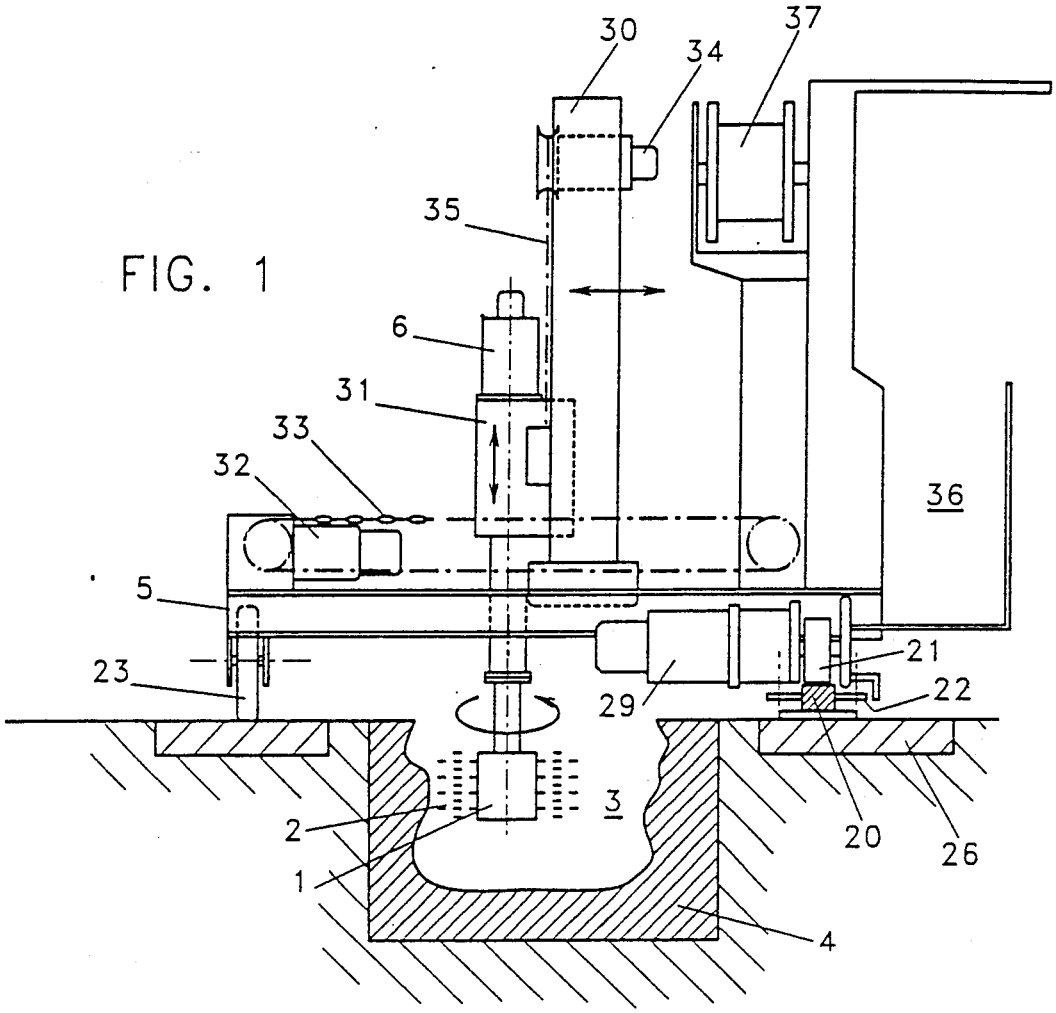
FIG. 1 shows a section through the conveyor trough with a view of the apparatus for cleaning the trough.

As shown in FIG. 1, the cleaning head of the illustrated apparatus consists of a drum 1, to which chains 2 are fastened, which, when the drum rotates, remove slag which has been deposited and loose components of the refractory material of the lining 4 from the wall of the conveyor trough 3, e.g., as disclosed in German Patent No. 32 25 015.

The apparatus has carriage 5. On this carriage, a column 30 can be moved transverse to the trough. On the column 30 there is a sled 31, which is guided so that it moves in the vertical direction. The lateral displacement of the column 30 and thus also of the cleaning head comprising drum 1 and chains 2, is accomplished by means of a motor 32, preferably by means of a chain hoist 33. The height adjustment of the cleaning head comprising drum 1 and chains 2, is performed by a motor 34, and hereagain, a chain 35 is appropriate on account of the harsh and dusty environment of a blast furnace. There is a motor 6 on the sled 31 to drive the drum 1. The apparatus also has a control stand 36. There can be a cable drum 37 to supply electrical energy to the apparatus.

On one side of the carriage 5, there are wheels 21 which are preferably driven individually by means of traction motors 29. The wheels 21 run on the guide rail 20, such as shown in section in FIG. 1. Somewhere in the vicinity of the wheels 21, preferably adjacent thereto, are non-powered lateral guide rollers 22 which can rotate around vertical axes. These guide rollers 22 run laterally on the guide rail 20 and provide lateral guidance when the wheels 21 are driven and also absorb the lateral forces acting carriage 5 during cleaning of the trough. There is a single non-powered idler roller 23 located on the on the carriage 5 other side of the trough. The idler roller 23 can have a diameter which is larger than that of the wheels 21, so that it can more easily roll over uneven spots on the floor or ground. The existence of a separate drive 29 for each wheel 21 is advantageous when one of the wheels becomes disengaged from the rail 20. In such an instance, propulsion would still be possible by means of the other, engaged wheel 21, and such propulsion by the engaged wheel would at least contribute to solving the problem at hand. It should be noted that this possibility of a mechanical solution to a wheel disengagement problem greatly reduces the potential necessity of manual access to the rail area wherein, even during the cleaning process, the vicinity of the conveyor trough is still so hot that it is not necessarily or easily accessible.

Figure 2:
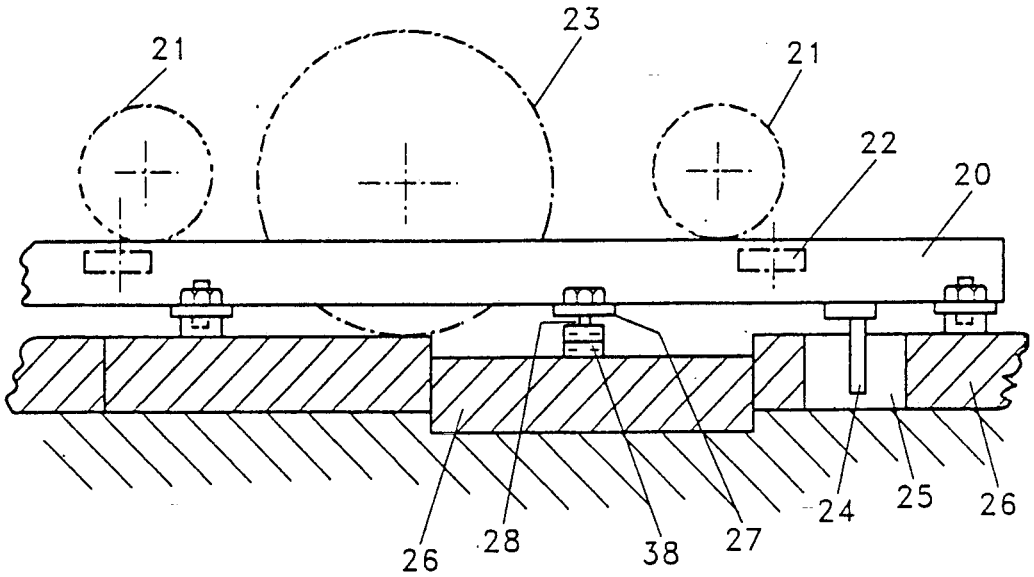
FIG. 2 shows a side view of one end of a guide rail.

As shown in FIG. 2, below the guide rail 20, there are a number of small plates 27 at some distance from one another, by means of which the guide rails are laid on slabs or thick metal plates 26 which are embedded in the building floor. Threaded bolts 28 can be used as adjusting screws in the plates 27 to compensate for irregularities in the floor. In place of the threaded bolts 28 shown, or in addition to them, other suitable compensation means can also be used, e.g. stackable shims 38 which fit into one another. Normally, a relatively rough straightening of the rails suffices. Approximately at the end of the rails, preferably at a distance of two-thirds of the trough length, there are guide bolts 24 on their undersides, which can be inserted in slot 25 of a plate 26.

The one piece guide rail 20, which can be 20 m long, for example, is removed during normal operation of the conveyor trough and can easily be removed by a crane. For the cleaning process, it can be very easily reinstalled by means of the bolts 24 and the slots 25. The cleaning apparatus itself can also be stored by a crane in a holding location during normal trough operation of the conveyor. If there are several conveyor troughs of approximately equal length in a blast furnace operation, then the apparatus and guide rail can be used alternately for cleaning these troughs.

Figure 3:
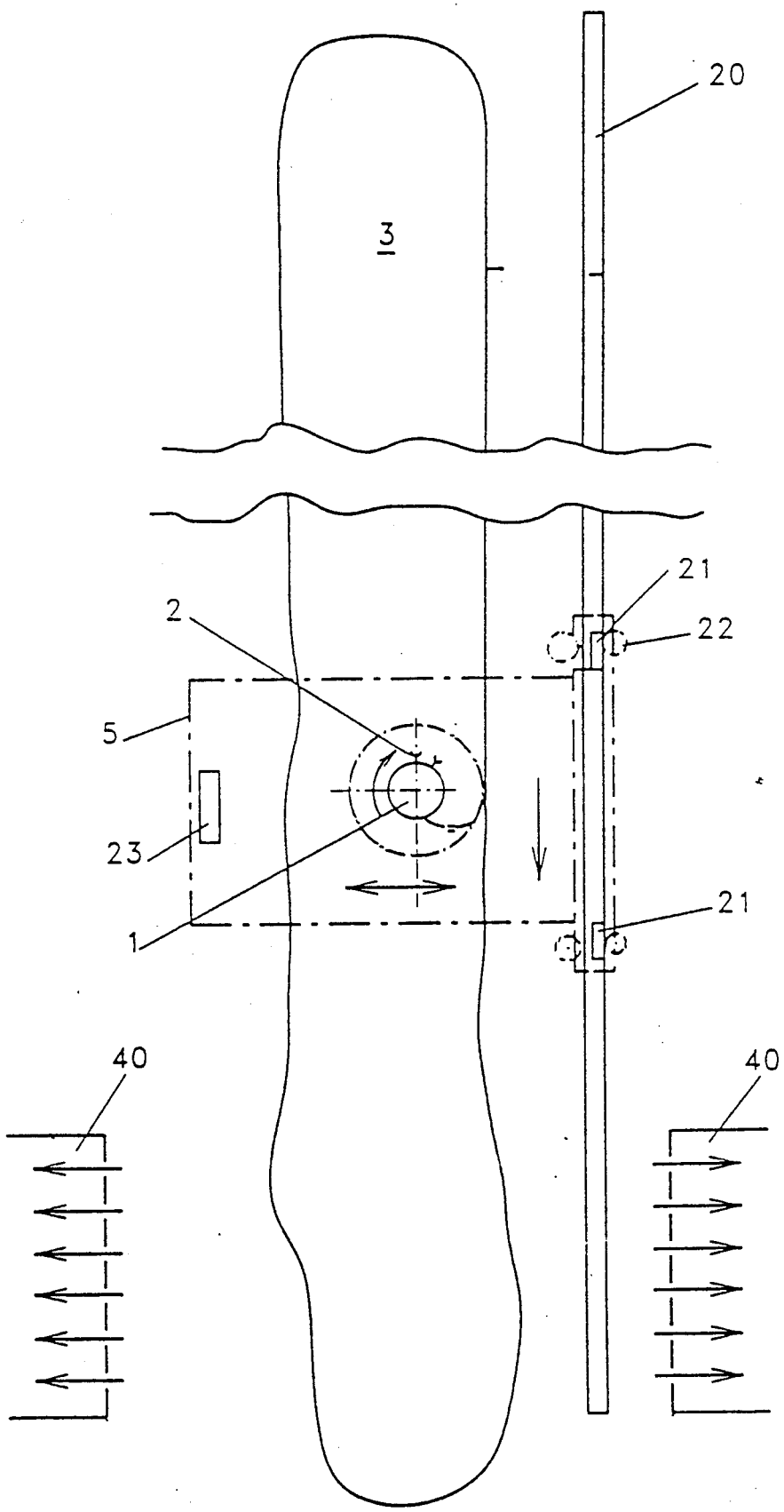
FIG. 3 shows a view of a conveyor trough with a guide rail lying next to it and a schematically indicated apparatus for cleaning.

FIG. 3 shows a conventional conveyor trough for a blast furnace with a guide rail 20 installed near the trough and with the schematically indicated apparatus. By means of the guide rail 20 and the lateral guide rollers 22, the apparatus easily runs parallel to the center of the conveyor trough 3. A transverse displacement of the drum 1 is necessary only if it is required by the condition of the trough wall or its curvature. If necessary, the apparatus can also be retracted to repeat the cleaning process on a particular spot. The guidance of the apparatus on the rail 20 facilitates the process significantly, and in particular, is not affected by irregularities of the building floor in the vicinity of the conveyor trough. FIG. 3 also shows suction devices 40, by means of which the gases and/or smoke produced during trough operation can be evacuated, and which can also extract some of the dust formed during the cleaning.

This invention is not restricted to the cleaning apparatus with chains on a drum illustrated in the examples. It can also be used for trough cleaning machines which work with other cleaning heads.

In summary, one feature of the invention resides broadly in an apparatus to clean refractory-lined conveyor troughs for molten metals and slags by means of chains 2 which are located on a rotating drum 1, with a rail-guided carriage 5 which can move in the longitudinal direction over the conveyor trough, characterized by the fact that on one side of the conveyor trough 3 there is a single easily-removable guide rail 20, and the carriage 5 on the side of the guide rail 20 has two wheels 21, at least one of which is driven by a traction motor 29 and two pairs of lateral guide rollers 22 which can rotate around vertical axes, and a non-powered idler roller 23 on the other side.

Another feature of the invention resides broadly in an apparatus which is characterized by the fact that the guide rail 20, on its underside, has guide bolts 24, which can be inserted in slots 25 in metal plates 26, which slots 25 run parallel to the center of the trough 3.

Yet another feature of the invention resides broadly in an apparatus which is characterized by the fact that the guide rail 20 on its underside is equipped with a number of small plates 27, in which there are threaded bolts 28 to adjust to the smelting building floor, which changes under the effect of heat, or to the plates 26.

A further feature of the invention resides broadly in an apparatus which is characterized by the fact that the guide rail 20 is a steel section, which extends in one piece over the length of the conveyor trough 3 and has a guide bolt 24 only approximately at each end, preferably at a distance of approximately two-thirds of the trough length.

A yet further feature of the invention resides broadly in an apparatus to clean refractory-lined conveyor troughs for molten metals and slags by means of chains 2 which are located on a rotating drum 1, with a rail-guided carriage 5 which can move in the longitudinal direction over the conveyor trough, characterized by the fact that on one side of the conveyor trough 3 there is a single easily-removable guide rail 20, and the carriage 5 on the side of the guide rail 20 has two wheels 21, at least one of which is driven by a traction motor 29 and two pairs of lateral guide rollers 22 which can rotate around vertical axes, and a non-powered idler roller 23 on the other side, and that the guide rail 20, on its underside, has guide bolts 24, which can be inserted in slots 25 in metal plates 26, which slots 25 run parallel to the center of the trough 3.

Yet another further feature of the invention resides broadly in an apparatus which is characterized by the fact that the guide rail 20 on its underside is equipped with a number of small plates 27, in which there are threaded bolts 28 to adjust to the smelting building floor, which changes under the effect of heat, or to the plates 26.

An additional feature of the invention resides broadly in an apparatus which is characterized by the fact that the guide rail 20 is a steel section, which extends in one piece over the length of the conveyor trough 3 and has a guide bolt 24 only approximately at each end, preferably at a distance of approximately two-thirds of the trough length.

All, or substantially all, of the components and methods of the various embodiments may be used with at least one embodiment or all of the embodiments, if any, described herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. An apparatus for cleaning a refractory-lined conveyor trough for conveying molten metals and slags, said apparatus comprising:

a rail-guided carriage which is movable over and along the conveyor trough, and which carriage extends across the trough;

a cleaning apparatus being mounted to said rail-guided carriage;

at least one guide rail for being disposed along a first surface adjacent a first side of the trough;

said rail-guided carriage having two wheels for being disposed on said at least one guide rail, said two wheels being spaced apart from one another, at least one of said two wheels being motor driven;

said two wheels being engageable with said guide rail for carrying said carriage along said guide rail;

means for permitting movement of said carriage along a second surface adjacent a second side of the trough opposite the first side thereof; and said means for permitting movement and said two wheels providing said carriage with only three contact points for contacting said at least one guide rail and the second surface on the opposite side of the trough.

2. An apparatus for cleaning a refractory-lined conveyor trough for conveying molten metals and slags according to claim 1 wherein said at least one guide rail is removable.

3. An apparatus for cleaning a refractory-lined conveyor trough for conveying molten metals and slags according to claim 2 wherein said means for permitting movement of said carriage along said second side of the trough comprises a non-powered idler roller.

4. An apparatus for cleaning a refractory-lined conveyor trough for conveying molten metals and slags according to claim 3 including a lateral guidance means.

5. An apparatus for cleaning a refractory-lined conveyor trough for conveying molten metals and slags according to claim 4 wherein said lateral guidance means comprises at least one pair of rollers disposed adjacent each of said two wheels.

6. An apparatus for cleaning a refractory-lined conveyor trough for conveying molten metals and slags as defined in claim 1, wherein said cleaning apparatus comprises a rotatable drum having chains fastened thereto.

7. An apparatus for cleaning a refractory-lined conveyor trough for conveying molten metals and slags as defined in claim 6, wherein said guide rail is for being disposed on a plurality of metal plates provided on the floor along the length of the trough, at least one of said metal plates having a slot therein.

8. An apparatus for cleaning a refractory-lined conveyor trough for conveying molten metals and slags as defined in claim 7, wherein said guide rail comprises at least one positioning guide which is insertable into said slot.

9. An apparatus for cleaning a refractory-lined conveyor trough for conveying molten metals and slags as defined in claim 8, wherein said guide-rail comprises a leveling means for compensating for irregularities between said guide rail and said metal plates, said leveling means comprising a plurality of plates smaller than said metal plates, said smaller plates provided on the underside of said guide rail.

10. An apparatus for cleaning a refractory-lined conveyor trough for conveying molten metals and slags according to claim 9, wherein said levelling means comprises at least one of:

threaded bolts to be used as adjusting screws in said smaller plates; and stackable shims for being disposed between said guide rail and said metal plates.

11. An apparatus to clean refractory-lined conveyor troughs for conveying molten metals and slags, said apparatus comprising:

a single removeable guide rail for being disposed along a first surface adjacent a first side of the trough;

a rail-guided carriage which is movable in the longitudinal direction over the conveyor trough, and extends across the trough;

a cleaning apparatus mounted on said rail-guided carriage;

two wheels on said carriage, at least one of which is motor driven, engageable with said guide rail, said two wheels being spaced apart from one another, and each of said two wheels having a diameter;

at least one pair of lateral guide rollers which can rotate around a vertical axis, each roller of said at least one pair for being disposed on opposite sides of the guide rail adjacent one of said wheels;

a non-powered idler roller on said carriage for being disposed on a second surface adjacent a second side of the trough opposite the first side of the trough; and said two wheels and said non-powered idler roller providing said carriage with only three points of contact for contacting said guide rail and the second surface on the opposite side of the trough.

12. An apparatus to clean refractory-lined conveyor troughs for molten metals and slags as defined in claim 11, wherein said cleaning apparatus comprises a rotatable drum having chains fastened thereto.

13. An apparatus to clean refractory-lined conveyor troughs for molten metals and slags as defined in claim 12, wherein a plurality of metal plates are provided on a floor beneath said guide rail along the length thereof.

14. An apparatus to clean refractory-lined conveyor troughs for molten metals and slags as defined in claim 13, wherein at least one of said metal plates has a slot therein and said positioning means is provided on the underside of said guide rail, said positioning means for being inserted into said slot.

15. An apparatus to clean a refractory-lined conveyor troughs for molten metals and slags as defined in claim 14, wherein a plurality of small plates are provided on the underside of said guide rail and said height adjusting means are provided for compensating for irregularities between the guide rail and said metal plates.

16. An apparatus to clean refractory-lined conveyor troughs for molten metals and slags as defined in claim 15, wherein said height adjusting means comprises at least one of:

threaded bolts used as adjusting screws in said small plates; and stackable shims for being disposed between said metal plates and said guide rail.

17. An apparatus for cleaning a refractory-lined conveyor trough for conveying molten metals and slags as defined in claim 12, wherein all angles of said triangular base of contact are acute angles, and said triangular base of contact forms substantially an Isosceles triangle.

18. An apparatus to clean a refractory-lined conveyor trough for molten metals and slags as defined in claim 16, wherein all angles of said triangular base of contact are acute angles, and said triangular base of contact forms substantially an Isosceles triangle.

19. An apparatus for cleaning a refractory-lined conveyor troughs for conveying molten metals and slags, said trough having a transverse axis, a longitudinal axis, and a vertical axis, said apparatus comprising:

a rotatable drum, said rotatable drum having chains disposed thereon, said rotatable drum being movable about said vertical axis and said transverse axis;

a motor for rotating said rotatable drum;

at least one guide rail for being disposed on a first surface adjacent a first side of the trough, said at least one guide rail being removable from said first surface, said at least one guide rail comprising:

positioning means for guiding said at least one guide rail into position on said first surface, said positioning means comprising means for releasing said rail and said positioning means permitting removal of said rail from said first surface;

said release means comprising means for total removal of a substantial portion of said positioning means protruding from said first surface;

height adjusting means for adjusting a height of said at least one guide rail relative to said first surface;

a rail-guided carriage for supporting said rotating drum and said motor, said rail guided carriage being movable over and along the trough, said rail-guided carriage comprising:

two wheels for being disposed on said at least one guide rail, said two wheels being spaced apart from one another and at least one of said two wheels being motor driven;

a pair of lateral guide rollers disposed adjacent each of said two wheels, said lateral guide rollers rotating about a vertical axis for maintaining each of said two wheels on said guide rail;

a single roller for being disposed on a second surface adjacent a second side of the trough opposite the first side; and said single wheel being disposed perpendicularly to a line joining said two wheels.

20. The apparatus for cleaning refractory-lined conveyor troughs for conveying molten metals and slags according to claim 19, wherein;

said positioning means comprises bolt means disposed on said guide rail;

said release means comprises slot means in said first surface, said bolt means for being inserted into said slot means; and said height adjusting means comprises at least one of:

threaded bolts disposed on said guide rail; and stackable shims for being placed between said guide rail and said first surface.

* * * * *